US011297966B2

(12) United States Patent
Alonso

(10) Patent No.: US 11,297,966 B2
(45) Date of Patent: Apr. 12, 2022

(54) PRIVACY OR CUBICLE CURTAIN SYSTEM AND CARRIER THEREOF

(71) Applicant: EMEH, INC., Lebanon, NJ (US)

(72) Inventor: Alberto Alonso, Del Rio, TX (US)

(73) Assignee: EMEH, INC., Lebanon, NJ (US)

( * ) Notice: Subject to any disclaimer, the term of this patent is extended or adjusted under 35 U.S.C. 154(b) by 100 days.

(21) Appl. No.: 16/859,883

(22) Filed: Apr. 27, 2020

(65) Prior Publication Data

US 2021/0330113 A1 Oct. 28, 2021

(51) Int. Cl.

*A47H 1/18* (2006.01)
*E04H 15/04* (2006.01)
*A47H 23/10* (2006.01)

(52) U.S. Cl.

CPC ..... *A47H 1/18* (2013.01); *A47H 23/10* (2013.01); *E04H 15/04* (2013.01)

(58) Field of Classification Search

CPC . A47H 1/18; A47H 1/19; A47H 5/032; A47H 13/04; A47H 15/00; A47H 15/02; A47H 15/04; A47H 23/05; A47H 23/02; A47H 23/10; E06B 2009/3265; E06B 9/362; E06B 9/367; E04H 15/04

See application file for complete search history.

(56) References Cited

U.S. PATENT DOCUMENTS 1,721,338 A * 7/1929 Gagnon ..... A47H 13/02 16/87.8
2,884,054 A * 4/1959 Bryant ..... A47H 23/05 160/332
4,091,857 A * 5/1978 Jacobs ..... A47H 1/18 160/330
4,424,852 A * 1/1984 Hopper ..... E06B 9/78 160/309
5,421,059 A * 6/1995 Letters, Jr. ..... A47H 1/104 16/87.4 R
6,044,523 A * 4/2000 Ortega ..... E06B 9/326 16/428
6,431,248 B1 * 8/2002 Hyman ..... E06B 9/32 160/178.1 R
6,910,517 B1 * 6/2005 Randall ..... E06B 9/326 160/178.1 R
9,320,380 B2 4/2016 Bronovicki et al.
2009/0288783 A1 * 11/2009 Graneto, III ..... A47H 1/04 160/341
2011/0073260 A1 * 3/2011 Kollman ..... E06B 9/262 160/84.04

(Continued)

FOREIGN PATENT DOCUMENTS

EP 2530234 A1 * 12/2012 ..... E06B 9/322

*Primary Examiner* — Daniel P Cahn
*Assistant Examiner* — Matthew R. Shepherd
(74) *Attorney, Agent, or Firm* — Baker Botts L.L.P.

(57) ABSTRACT

Certain embodiments describe a privacy or cubicle curtain system and a carrier utilized by the system. For example, certain embodiments can be directed to a breakaway carrier. The breakaway carrier can include a first holder comprising one or more first legs and/or a second holder comprising one or more second legs. The breakaway carrier can include a central leg located between the first holder and second holder. The breakaway carrier can include a chain having a first end and a second end, wherein the first end is located in the first holder and the second end is located in the second holder.

19 Claims, 3 Drawing Sheets

(56) References Cited

U.S. PATENT DOCUMENTS

| | | | | |
|---|---|---|---|---|
| 2012/0000616 | A1* | 1/2012 | DeWees | A47H 1/08 160/330 |
| 2012/0167350 | A1* | 7/2012 | Chou | E06B 9/262 24/115 F |
| 2016/0017655 | A1* | 1/2016 | Genzel | E06B 9/326 24/303 |

* cited by examiner

PRIVACY OR CUBICLE CURTAIN SYSTEM AND CARRIER THEREOF

FIELD

The present disclosure relates generally to a privacy or cubicle curtain system and a carrier utilized therein. In particular, the present disclosure relates to a breakaway carrier used to hang the cubicle or privacy curtain.

BACKGROUND

Drawable cubicle or privacy curtains are commonly used in various facilities to surround a given area. In healthcare facilities, the cubicle or privacy curtains are often used to surround or enclose patients to ensure privacy. Cubicle or privacy curtains are generally hung from or on a track system via one or more carriers that can slide within or over the track system. Most carriers use conventional hooks to hang or hold the cubicle or privacy curtain.

In some vulnerable patient populations, it is important that carriers are designed to break when a certain level of pulling pressure is exerted on the curtain. Such carriers are referred to as breakaway carriers, and can help to prevent vulnerable patients from using the curtain to harm themselves or induce self-pain. Traditionally when a pulling pressure is applied to the curtain, breakaway carriers with hooks can separate or break into two or more pieces. When breaking apart these separated pieces of the carrier can inflict harm or potentially maim patients. The separated pieces can also be deliberately or accidentally ingested by the patients.

In view of the above, a need exists in the art for a breakaway carrier that can improve patient safety, as well as a privacy or cubicle system that includes the improved breakaway carrier.

SUMMARY

Accordingly, the disclosed subject matter described below provides various non-limiting examples of an improved breakaway carrier and privacy or cubicle system that includes the improved breakaway carrier. The improved breakaway carrier can increase patient safety and overcome some of the defects of traditional breakaway carriers.

In certain non-limiting embodiments, a breakaway carrier can include a first holder comprising one or more first legs and a second holder comprising one or more second legs. The breakaway carrier can include a central leg located between the first holder and second holder, and a chain having a first end and a second end, wherein the first end is located in the first holder and the second end is located in the second holder. The breakaway carrier can be a spool carrier. The first holder and the second holder can be located on a bottom surface of the breakaway carrier. In some embodiments the chain can comprise plastic and/or can be a ball chain. The first end of the chain can be held in place by place by at least one first protrusion located on the one or more first legs or the central leg, and the second end of the chain can be held in place by at least one second protrusion located on the one or more second legs or the central leg. The first end of the chain can be held within a first recess of the first holder, and the second end of the chain can be held within a second recess of the second holder.

In some non-limiting embodiments, if and/or when the first end of the chain is pulled out of the first holder, the second end of the chain can remain located within the second holder. In other non-limiting embodiments, if and/or when the second end of the chain is pulled out of the second holder, the first end of the chain can remain located within the first holder. The carrier can have a weight capacity of 20 pounds. In one non-limiting embodiment the second holder and/or the first holder comprises three of the one or more first legs. The carrier, one or more first legs, and/or one or more second legs can be composed of plastic. In some non-limiting embodiments, the chain of the carrier can be threaded or inserted through a hole of a privacy or cubicle curtain.

Certain non-limiting embodiments can include a privacy or cubicle curtain system. The system can include a track system and a breakaway carrier that slides in or over the track system. The breakaway carrier can include a first holder including one or more first legs and a second holder including one or more second legs. The breakaway carrier can include a central leg located between the first holder and second holder and a chain having a first end and a second end, wherein the first end is located in the first holder and the second end is located in the second holder. The system can include a privacy or cubicle curtain hanging from the breakaway carrier, wherein the chain of the breakaway carrier is threaded or inserted through a hole of the privacy or cubicle curtain.

The breakaway carrier of the privacy or cubicle curtain system can be a spool carrier. The first holder and the second holder can be located on a bottom surface of the carrier. In some embodiments the chain can comprise plastic and/or can be a ball chain. The first end of the chain can be held in place by place by at least one first protrusion located on the one or more first legs or the central leg, and the second end of the chain can be held in place by at least one second protrusion located on the one or more second legs or the central leg. The first end of the chain can be held within a first recess of the first holder, and the second end of the chain can be held within a second recess of the second holder. In some non-limiting embodiments, if and/or when the first end of the chain is pulled out of the first holder, the second end of the chain can remain located within the second holder. In other non-limiting embodiments, if and/or when the second end of the chain is pulled out of the second holder, the first end of the chain can remain located within the first holder. The carrier can have a weight capacity of 20 pounds. In one non-limiting embodiment the second holder and/or the first holder comprises three of the one or more first legs.

BRIEF DESCRIPTION OF THE DRAWINGS

FIG. 1(*b*) illustrates a non-limiting example of a side view of the breakaway carrier illustrated in FIG. 1(*a*).

FIG. 2(*b*) illustrates a non-limiting example of a side view of the breakaway carrier illustrated in FIG. 2(*a*).

DETAILED DESCRIPTION

Reference will now be made in detail to the various exemplary embodiments of the disclosed subject matter, which embodiments are illustrated in the accompanying drawings. The examples and embodiments described below are merely exemplary, and should not be taken in any way to limit the scope of the disclosed subject matter.

Figure 1A:
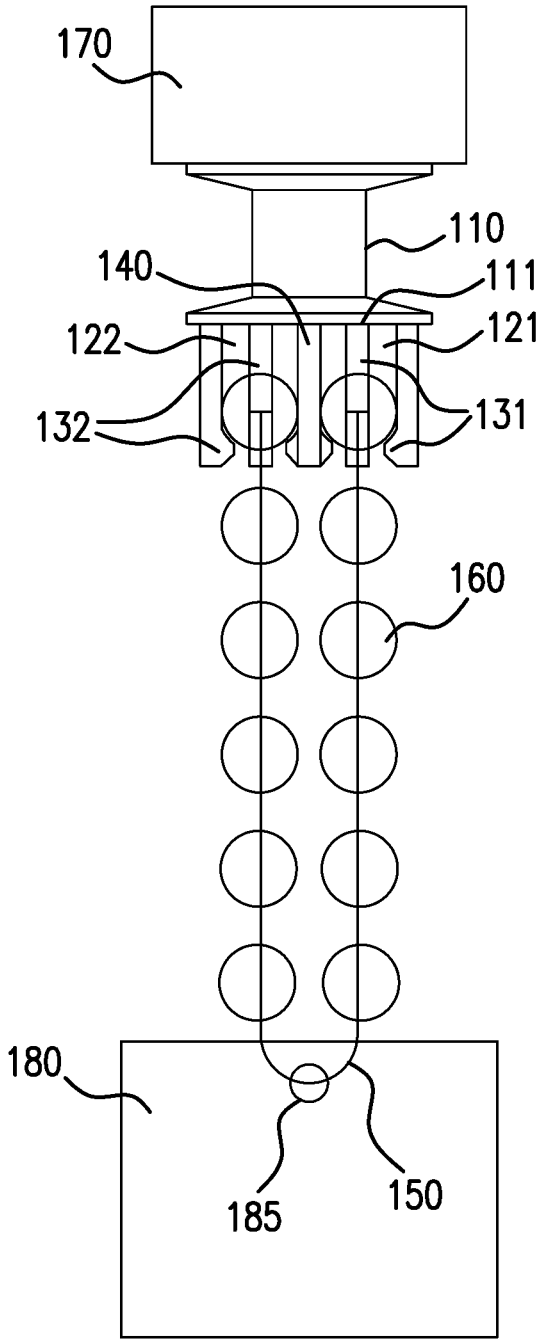
FIG. 1(*a*) illustrates a non-limiting example of a front view of a breakaway carrier according to certain embodiments.
Figure 1B:
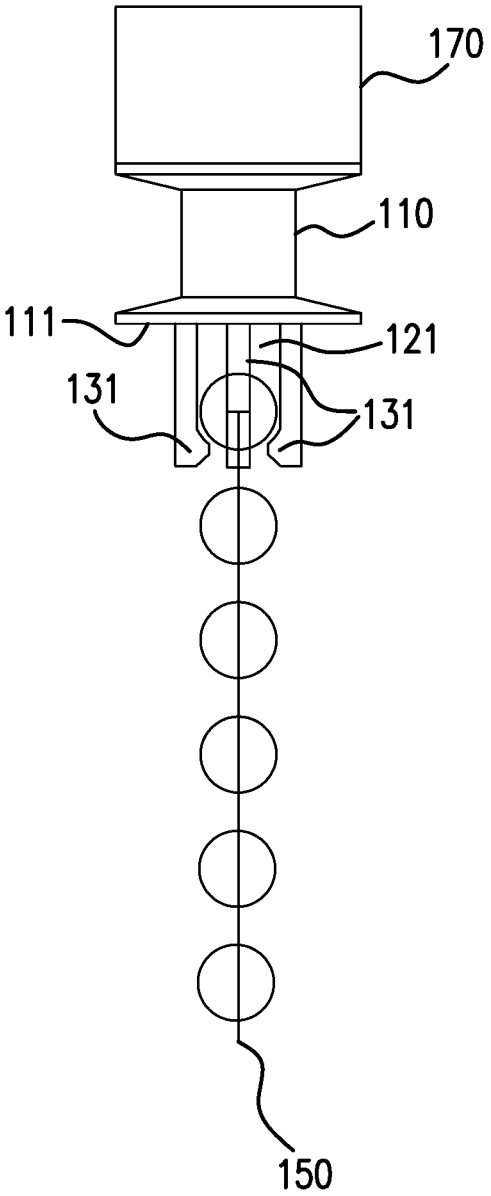
Figure 3:
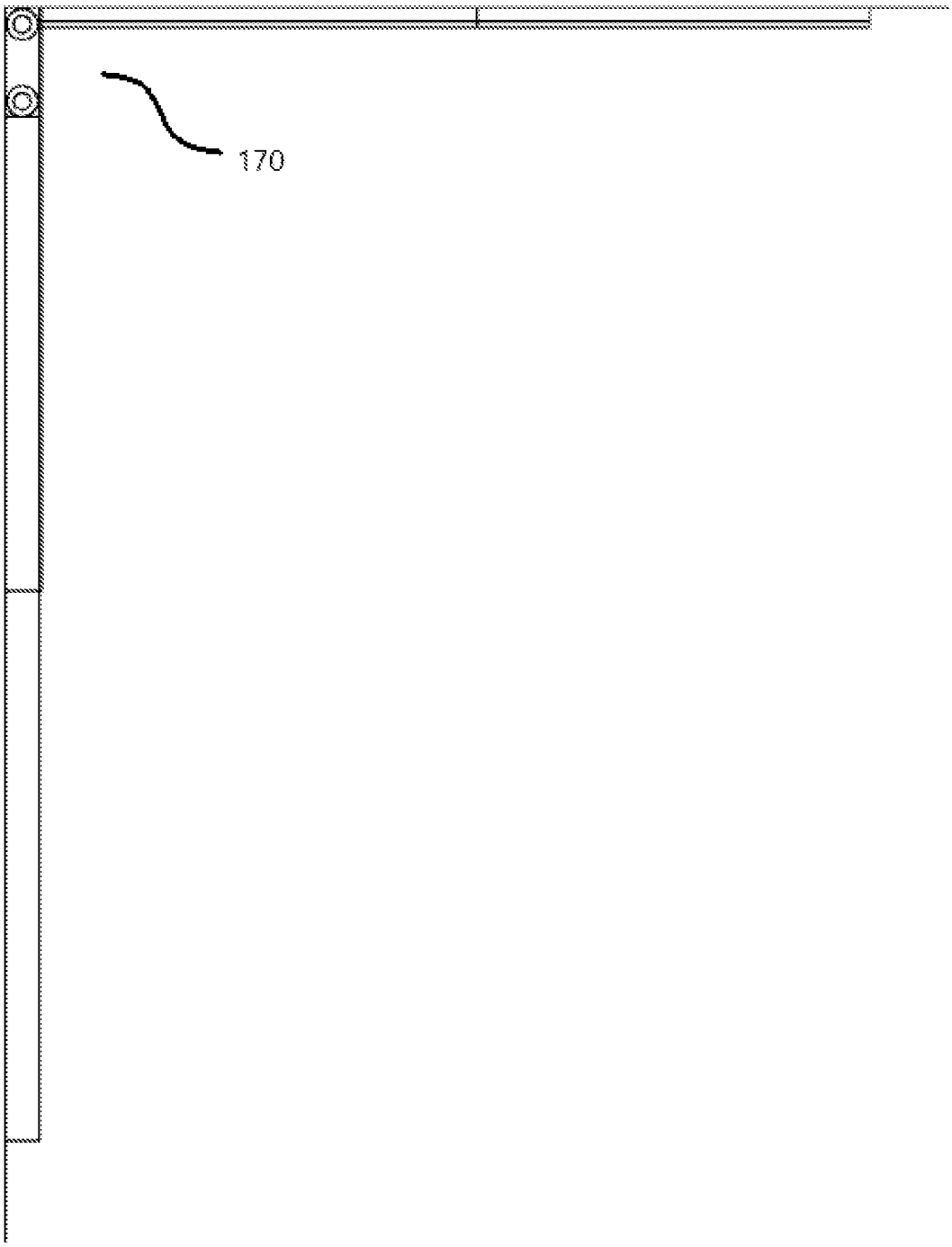
FIG. 3 is a planar side view of a further exemplary embodiment of the cubicle curtain loading system of the present invention; specifically a "permanent" cubicle curtain loading system affixed to the wall of a structure adjacent a track system.

FIG. 1(*a*) illustrates a non-limiting example of a front view of a breakaway carrier according to certain embodiments. In particular, FIG. 1(*a*) illustrates breakaway carrier 110 as a spool carrier. In some other embodiments, however, the breakaway carrier can be in the form of a roller carrier or any other type of carrier known in the art. As part of the privacy or cubicle curtain system, the carrier can be used to hang the cubicle or privacy curtain from the track system 170. The track system 170 can be attached to a ceiling, floor, and/or side wall of a healthcare facility based on the desired privacy or cubicle area. FIG. 3 illustrates an exemplary track system 170 according to the present invention and which is described in U.S. Pat. No. 9,320,380 B2. U.S. Pat. No. 9,320,380 B2 is hereby incorporated by reference in its entirety.

Breakaway carrier 110 can slide, roll, glide, or otherwise move within or over the track system 170. In some embodiments breakaway carrier 110 can be manually moved within or over the track system 170 by a user, while in other embodiments breakaway carrier 110 can be automatically moved using one or more mechanical or electronic mechanism. A user, for example, can be a patient, a health professional, such as a physician, physician assistant, nurse, or any other employee or visitor of the healthcare facility in which the privacy or cubicle curtain 180 is located. Breakaway carrier 110 can be used to connect, hang, or hold the cubicle or privacy curtain 180. In some non-limiting embodiments, the breakaway carrier can include a hook, chain, loop, clip, wire, tab, or any other connector used to hang or hold the privacy or cubicle curtain 180. In FIG. 1(*a*), for example, the carrier includes a chain 150 that can be threaded through one or more holes 185 of the privacy or cubicle curtain 180. Threaded through can mean that one end of chain 150 is inserted through the one or more holes 185 of the privacy or cubicle curtain 180 to allow the curtain to rest on chain 150.

The privacy or cubicle curtains 180 can be composed of a single material or a combination of materials. For example, the curtains 180 can be fabricated with nylon, polyester, polypropylene, vinyl, non-vinyl, linen, any other known curtain material, or any combination thereof. In certain non-limiting embodiments the fabric of the privacy or cubicle curtain 180 can be fire retardant, recyclable, and/or antimicrobial. Given that the privacy or cubicle curtain can be used in a healthcare facility or environment, the curtain can become dirty or soiled. In some embodiments the one or more materials included within the curtain 180 can allow the curtain 180 to be removed and cleaned or washed.

In certain non-limiting embodiments breakaway carrier 110 can include one or more holders. In the example embodiment shown in FIG. 1(*a*), breakaway carrier 110 includes a first holder 121 and a second holder 122. A central leg 140 can be located between first holder 121 and second holder 122. In some non-limiting embodiments first holder 121 and second holder 122 can include one or more distinct legs 131, 132 that are separated from one another. For example, as illustrated in FIG. 1(*a*) first holder 121 can include three legs 131 and/or second holder 122 can include three legs 132. In other non-limiting embodiments first holder 121 and second holder 122 can include any other number of legs 131, 132. Legs 131, 132, for example, can define the boundaries of the recess included within first holder 121 and second holder 122. In some non-limiting embodiments one or more legs 131, 132 can be circumferentially equally distanced from one another. In other non-limiting embodiments, however, the one or more distinct legs 131, 132 can be distanced from one another by any length or distance, circumferential or otherwise. The length or distance can be determined based on the holding needed to maintain the first end or second end of chain 150 within first holder 121 or second holder 122. The holding force can be determined based on the maximum weight resistance of the carrier. The weight resistance of carrier 110 shown in FIG. 1(*a*), for example, can be 20 pounds. In other non-limiting embodiments, the weight resistance of carrier 110 can be any other amount, such as, 1 to 150 pounds. In some non-limiting embodiments, for example, the weight resistance can be 5 pounds, 10 pounds, 15 pounds, 25 pounds, 30 pounds, 35 pounds, 40 pounds, 45 pounds, or 50 pounds.

The proximal end of legs 131, 132 of first holder 121 and second holder 121 can be located on bottom surface 111 of carrier 110. In FIG. 1(*a*), legs 131, 132 can be molded or attached directly to bottom surface 111 of carrier 110. Alternatively, legs 131, 132 can be attached or connected to carrier 110 using any known method, such as gluing, crimping, clipping, soldering, brazing, taping, or fastening. In some other non-limiting embodiments, first holder 121 and/or second holder 122 can include a top surface to which legs 131, 132 are attached. The top surface of first holder 121 and/or second holder 122 can then be attached directly to bottom surface 111 of carrier 110.

The distal ends of one or more of legs 131, 132 can include an inwardly facing protrusion, as shown in FIG. 1(*a*). Inwardly facing means that the protrusion can face towards the recess defined by legs 131, 132 and central leg 140 within first holder 121 and second holder 122. In the embodiment shown in FIG. 1(*a*) the protrusion can be shaped as a trapezoid. In other non-limiting embodiments, the protrusion can be shaped as a half-circle or oval, triangle, square, rectangle, or any other suitable shape.

In certain non-limiting embodiments, central leg 140 can be located between first holder 121 and second holder 122. Similar to legs 131, 132, the proximal end of central leg 140 can be located on bottom surface 111 of carrier 110. In particular, central leg 140 can be attached or molded to bottom surface 111 of carrier 110. In some other non-limiting embodiments, central leg 140 can be attached or connected to carrier 110 using any known method, such as gluing, crimping, clipping, soldering, brazing, taping, or fastening. The distal end of central leg 140 can include one or more protrusions facing towards the recess of first holder 121 and second holder 122. Central leg 140 shown in FIG. 1(*a*) includes two protrusions, with each of the protrusions facing a respective protrusion of legs 131, 132. The protrusions of central leg 140 can be shaped as a trapezoid in FIG. 1(*a*). In other non-limiting embodiments, the protrusion of central leg 140 can be shaped as a half-circle or oval, triangle, square, rectangle, or any other suitable shape.

Legs 131 and central leg 140 can define a first recess within first holder 121, while legs 132 and central leg 140 can define a second recess within second holder 122. As shown in FIG. 1(*a*), a first end of chain 150 can be held by first holder 121 and second end of chain 150 can be held by second holder 121. Chain 150 can be a ball chain that includes one or more balls 160. The chain illustrated in FIG. 1(*a*) includes twelve balls that are connected via chain 150, while in other example embodiments chain 150 can include as few as one or two balls. Further, in other non-limiting embodiments chain 150 can be a simple wire or loop without any balls.

In certain non-limiting embodiments, a ball can be located on the first end of chain 150 and another ball can be located on the second end of chain 150. The first end of chain 150 can be held in place by at least one first protrusion located on one or more first legs 131 and/or by a protrusion located on central leg 140. In addition, the second end of chain 150 is held in place by at least one second protrusion located on one or more second legs 132 and/or by a protrusion located on central leg 140. In other words, the balls located on each of the first and second ends of chain 150 are held in place by the protrusions located on first legs 131, second legs 132, and/or central leg 140.

As described above, chain 150 can be threaded through a hole of a privacy or cubicle curtain. After threading or insertion, privacy or cubical curtain can rest between the first and second ends of chain 150. In some embodiments, the privacy or cubical curtain can rest on the distal or bottom most point of chain 150, which can be located in the middle of chain 150 between the first end and the second end. In certain non-limiting embodiments, a downward pressure, such as a pulling pressure, can be applied to the privacy or cubicle curtain. Such downward pressure can be exhibited, for example, when a patient in the healthcare facility pulls, climbs, or hangs from the curtain. This downward pressure on the curtain can be transferred to chain 150 and ultimately to carrier 110.

As discussed above, for patient safety and health reasons it can be helpful for carrier 110 to break away when a sufficient downward pressure is applied, without any part of the carrier becoming disjointed or separating off from carrier 110. Doing so can help to prevent ingestion of the separated part and/or prevent the separated part from acting as a projectile and potentially harming nearby individuals. In accordance with these safety goals, when a sufficient downward pressure is applied the first end of chain 150 can be pulled out of first holder 121, while the second end of chain 150 can remain located within second holder 122. The release of the first end of chain 150 from first holder 121 can allow the privacy or cubicle curtain to detach, while having the second end of chain 150 remain within second holder 122 can prevent chain 150 from detaching from carrier 110. Having one end of chain 150 remain intact within holder 122 can ensure that the carrier allows the curtain to detach without having the chain separate from carrier 110. In addition, allowing one end of chain 150 to detach, while the other end of chain 150 remains intact, can help to prevent the separation of carrier 110 from the track system.

Although in certain non-limiting embodiments the first end of chain 150 can be pulled out of first holder 121, while the second end of chain 150 can remain located within second holder 122, in other non-limiting embodiments when the second end of chain 150 can be pulled out of second holder 122, while the first end of chain 150 can remain located within first holder 121. In the example embodiment shown in FIG. 1(*a*), the weight resistance of carrier 110 can be 20 pounds. This can mean that either the first or second end of chain 150 can be pulled out when a force greater than 20 pounds is applied. In other embodiments, the weight resistance of carrier 110 can be any other amount between ranging from 1 to 150 pounds.

In certain non-limiting embodiments, second holder 122 can have a higher weight resistance than first holder 121, or visa versa. Having second holder 122 with a higher weight resistance can help to ensure that the first end of chain 150 releases from first holder 121, while the second end of chain 150 can still be maintained within second holder 122. Such embodiments can allow the curtain to release while carrier 110 remains intact with the track system and/or chain 150 remains connected to carrier 110. In some non-limiting embodiments, first end or second end of chain 150 can be fixed within first holder 121 and second holder 122. For example, first end of chain 150 can be fixed to one or more first legs 131 of holder 121, or second end of chain 150 can be fixed to one or more second legs 132 of holder 122. The fixing of the first or second end of chain 150 to one or more first legs 131 or second legs 132 can be done using any known method or process, such as mechanical fastening, heat or friction welding, or adhesive or solvent bonding. In other non-limiting embodiments the first or second end of chain 150 can be affixed to one or more first legs 131 or second legs 132, respectively, using any other known method or process.

In certain non-limiting embodiments, however, both ends of chain 150 can release from first and second holders 121, 122, allowing both chain 150 and the privacy or cubicle curtain to release upon a sufficient downward pull. Allowing both ends of chain 150 to release can prevent carrier 110 from separating from the track system.

In some non-limiting embodiments carrier 110, holders 121, 122, legs 131, 132, central leg 140, chain 150, and/or ball 160 can be composed of plastic. The plastic, for example, can be acetal homopolymer, acetal copolymer, or any other plastic having the desired tensile strength, impact resistance, stiffness, creep and/or fatigue resistance. In the example embodiment shown in FIG. 1(*a*), carrier 110, holders 121, 122, legs 131, 132, central leg 140, chain 150, and ball 160 are all composed of be acetal homopolymer. In other non-limiting embodiments, however, carrier 110, holders 121, 122, legs 131, 132, central leg 140, chain 150, or ball 160 can be made of any non-plastic material, such as a metal or molded nylon. The metal, for example, can be an aluminum alloy.

FIG. 1(*b*) illustrates a non-limiting example of a side view of the breakaway carrier illustrated in FIG. 1(*a*). In particular, FIG. 1(*b*) illustrates carrier 110, holder 121, legs 131, chain 150, and one or more balls 160 attached to chain 150 forming a ball chain. As shown in FIG. 1(*b*), holder 121 can be connected or attached to bottom surface 111 of carrier 110. From a side view, holder 121 is located in the center of bottom surface 111 of carrier 110. This can help to ensure that carrier 110 is capable of smoothly moving within or over the track system.

Figure 2A:
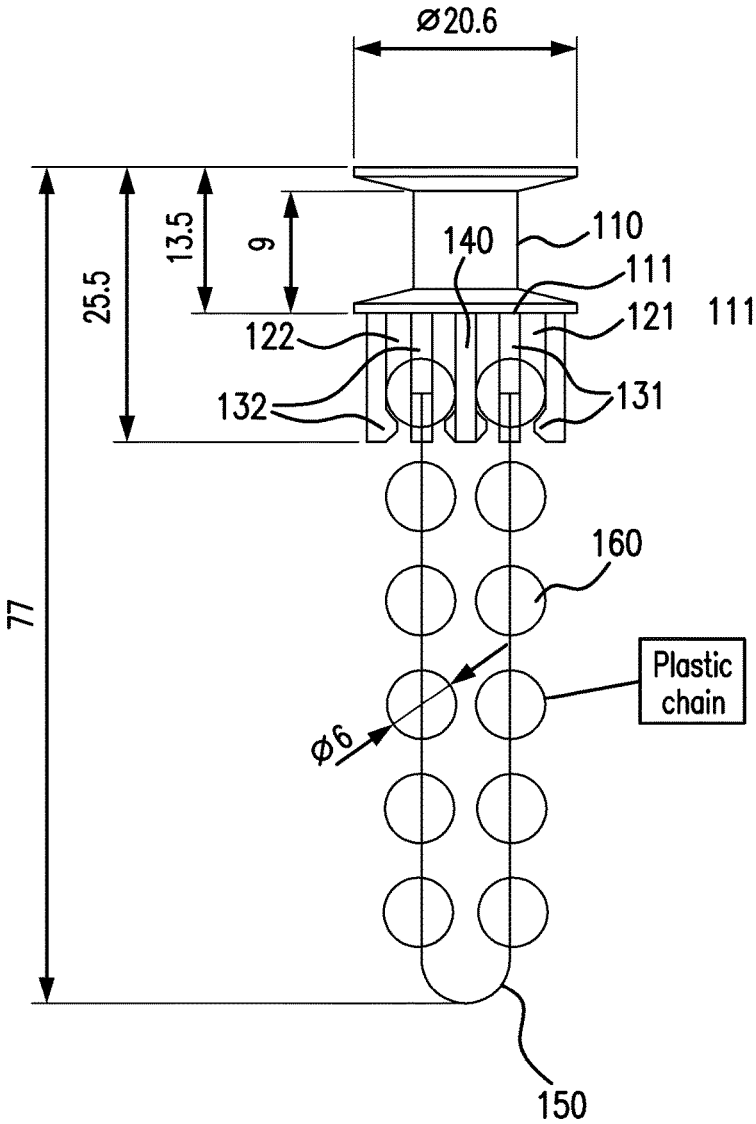
FIG. 2(*a*) illustrates a non-limiting example of a front view of a breakaway carrier having dimensions according to certain embodiments.
Figure 2B:
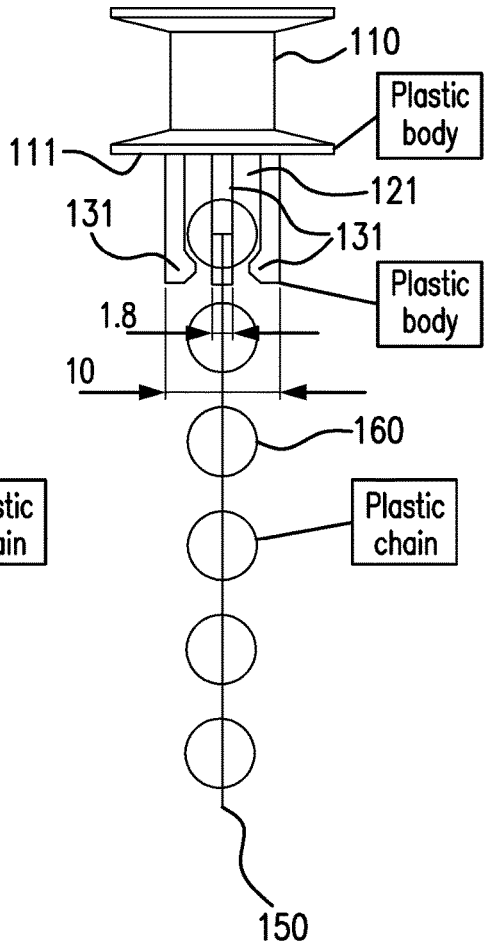

FIG. 2(*a*) illustrates a non-limiting example of a front view of a breakaway carrier having dimensions according to certain embodiments. In particular, FIG. 2(*a*) illustrates example dimensions of the carrier shown in FIG. 1(*a*). For example, the diameter of the top surface and bottom surface 111 of carrier 110 can be 20.6 millimeters (mm). In other non-limiting embodiments the diameter of either one of top surface and/or bottom surface 111 of carrier 110 can be any other value, such as between 1 to 254 mm. In one example the diameter of either one of top surface and/or bottom surface 111 of carrier 110 can be between 12.7 to 76.2 mm. The length of carrier 110 from bottom surface 111 to the top surface can be 13.5 mm, while the length of the top surface of carrier 110 to the distal end of legs 131, 132 can be 25.5 mm. The length from the top surface of carrier 110 to the bottom point of chain 150 can be 77 mm. Further, the diameter of one or more balls 160 can be 6 mm. As shown in FIG. 2(*a*), holders 121, 122 and their respective legs 131, 132 are equally sized. In addition, central leg 140 can have an equal or similar length and/or width to legs 131, 132.

FIG. 2(*b*) illustrates a non-limiting example of a side view of the breakaway carrier illustrated in FIG. 2(*a*). In particular, FIG. 2(*b*) illustrates that the width of legs 131 can be 1.8 mm. The width of legs 131, in certain non-limiting embodiments, can be equal or similar to legs 132 and/or central leg 140. The distance between the outer surfaces of two legs 131 can be 10 mm.

The features, structures, or characteristics of certain embodiments described throughout this specification can be combined in any suitable manner in one or more embodiments. For example, the usage of the phrases "certain embodiments," "some embodiments," "other embodiments," or other similar language, throughout this specification refers to the fact that a particular feature, structure, or characteristic described in connection with the embodiment can be included in at least one embodiment of the disclosed subject matter. Thus, appearance of the phrases "in certain embodiments," "in some embodiments," "in other embodiments," or other similar language, throughout this specification does not necessarily refer to the same group of embodiments, and the described features, structures, or characteristics can be combined in any suitable manner in one or more embodiments.

One having ordinary skill in the art will readily understand that the disclosed subject matter as discussed above can be practiced with procedures in a different order, and/or with hardware elements in configurations which are different from those disclosed. Therefore, although the disclosed subject matter has been described based upon these embodiments, it would be apparent to those of skill in the art that certain modifications, variations, and alternative constructions would be apparent, while remaining within the spirit and scope of the disclosed subject matter.

What is claimed is:

1. A breakaway carrier comprising:
a first holder comprising one or more first legs;
a second holder comprising one or more second legs;
a central leg located between the first holder and second holder; and
a chain having a first end and a second end, wherein the first end is located in the first holder and the second end is located in the second holder, and
wherein the first holder or the second holder comprises three of the one or more first legs or three of the one or more second legs, and a spool configured to slide within a track that opens or closes a curtain.

2. The breakaway carrier according to claim 1, wherein the breakaway carrier is a spool carrier.

3. The breakaway carrier according to claim 1, wherein the first holder and the second holder are located on a bottom surface of the breakaway carrier.

4. The breakaway carrier according to claim 1, wherein the chain is a ball chain.

5. The breakaway carrier according to claim 1, wherein the chain comprises plastic.

6. The breakaway carrier according to claim 1, wherein the first end of the chain is held in place by at least one first protrusion located on the one or more first legs or the central leg, and wherein the second end of the chain is held in place by at least one second protrusion located on the one or more second legs or the central leg.

7. The breakaway carrier according to claim 1, wherein the first end of the chain is held within a first recess of the first holder, and the second end of the chain is held within a second recess of the second holder.

8. The breakaway carrier according to claim 1, wherein when the first end of the chain is pulled out of the first holder, the second end of the chain remains located within the second holder.

9. The breakaway carrier according to claim 1, wherein the breakaway carrier has a weight capacity of 20 pounds.

10. The breakaway carrier according to claim 1, wherein the breakaway carrier, the one or more first legs, or the one or more second legs comprises plastic.

11. The breakaway carrier according to claim 1, wherein the first end of the chain is fixed within the first holder or the second end of the chain is fixed within the second holder.

12. A breakaway carrier comprising:
a first holder comprising one or more first legs;
a second holder comprising one or more second legs;
a central leg located between the first holder and second holder; and
a chain having a first end and a second end, wherein the first end is located in the first holder and the second end is located in the second holder, wherein the chain is threaded through a hole of a privacy or cubicle curtain.

13. A privacy or cubicle curtain system comprising:
a track system;
a breakaway carrier that slides in or over the track system, wherein the breakaway carrier comprises:
a first holder comprising one or more first legs,
a second holder comprising one or more second legs,
a central leg located between the first holder and second holder,
a chain having a first end and a second end, wherein the first end is located in the first holder and the second end is located in the second holder; and
a privacy or cubicle curtain hanging from the breakaway carrier, wherein the chain of the breakaway carrier is threaded through a hole of the privacy or cubicle curtain.

14. The privacy or cubicle curtain system according to claim 13, wherein the breakaway carrier is a spool carrier.

15. The privacy or cubicle curtain system according to claim 13, wherein the first holder and the second holder are located on a bottom surface of the spool carrier.

16. The privacy or cubicle curtain system according to claim 13, wherein the first end of the chain is held in place by at least one first protrusion located on the one or more first legs or the central leg, and wherein the second end of the chain is held in place by at least one second protrusion located on the one or more second legs or the central leg.

17. The privacy or cubicle curtain system according to claim 13, wherein the first end of the chain is held within a first recess of the first holder, and the second end of the chain is held within a second recess of the second holder.

18. The privacy or cubicle curtain system according to claim 13, wherein when the first end of the chain is pulled out of the first holder, the second end of the chain remains located within the second holder.

19. The privacy or cubicle curtain system according to claim 13, wherein the first end of the chain is fixed within the first holder or the second end of the chain is fixed within the second holder.

* * * * *